United States Patent [19]

Kawano et al.

[11] Patent Number: 4,566,244

[45] Date of Patent: Jan. 28, 1986

[54] PAPER SHEET GRIP AND TRANSFER APPARATUS

[75] Inventors: Hikaru Kawano, Odawara; Koji Sato, Hiratsuka, both of Japan

[73] Assignees: Musashi Engineering Kabushiki Kaisha, Tokyo; Hitachi Denshi Engineering Kabushiki Kaisha, Kanagawa, both of Japan

[21] Appl. No.: 601,795

[22] Filed: Apr. 19, 1984

[30] Foreign Application Priority Data

Apr. 30, 1983 [JP] Japan ..... 58-76488

[51] Int. Cl.[4] ..... B65B 35/50

[52] U.S. Cl. ..... 53/588; 53/542; 53/589; 221/219

[58] Field of Search ..... 53/542, 582, 588, 589, 53/593; 100/7; 209/534; 221/210, 219, 220; 269/237; 271/84, 85, 221, 222; 414/103, 225, 226, 753; 901/6, 14, 38

[56] References Cited

U.S. PATENT DOCUMENTS 3,522,838 4/1968 Ott ..... 414/753
3,761,080 5/1971 Larson ..... 271/222
4,229,136 10/1980 Panissidi ..... 414/753
4,424,660 1/1984 Sato et al. ..... 53/588

FOREIGN PATENT DOCUMENTS 541664 5/1977 U.S.S.R. ..... 901/14

*Primary Examiner*—James F. Coan
*Attorney, Agent, or Firm*—Brooks Haidt Haffner & Delahunty

[57] ABSTRACT

A paper sheet grip and transport apparatus for a counting and half-wrapping device comprising a stacker for accommodating a batch of paper sheets supplied thereto and for receiving them in the state of a bundle and a half wrapper for the bundle of paper sheets mounted adjacent to said stack unit, is disclosed. According to the present invention, the grip and transfer apparatus has a movable member mounted in alignment with said stack unit and said half-wrapping unit and having a transfer chuck adapted for being opened or closed and capable of gripping from the side of the half-wrapping unit a bundle of paper sheets placed in the stack unit. The movable member is driven from the side of said half-wrapping unit for transporting a bundle of paper sheets gripped by said transfer chuck from the stack unit towards the half-wrapping unit.

4 Claims, 5 Drawing Figures

PAPER SHEET GRIP AND TRANSFER APPARATUS

BACKGROUND OF THE INVENTION

This invention relates to a paper sheet counting and half-wrapping or band-sealing device and, more particularly, to a paper sheet transfer apparatus used in such device.

Heretofore, in this kind of the paper sheet transfer apparatus, after the number of paper sheets is counted, the sheets are pushed from the sides of their trailing edges and transported in this manner in the direction of the half-wrapping unit (Japanese Laid-Open Patent Specification No. 57-8616). It is also known to shift a pile of paper sheets onto a transfer belt, whereby the sheets are transferred in the free state without holding the sheets on the belt (Japanese Laid-Open Utility Model Specification No. 50-98791).

However, these known apparatuses are subject to deviation from the intended route, folding or loss of the paper sheets during transport thereof, or to insufficient tightness in half-wrapping caused by transverse shifting of the paper sheets during transport thereof towards the half-wrapping unit. Thus it is not possible with these known apparatuses to realize a positive transport or half-wrapping of the paper sheets.

SUMMARY OF THE INVENTION

It is therefore a principal object of the present invention to provide a transport apparatus, whereby the bundle of paper sheets is transferred by transfer chuck means as it is chucked by said chuck means for preventing the paper sheets from falling into a disorderly state during transport and also for preventing occurrence of insufficient tightness in half-wrapping.

In view of the foregoing object, the present invention is characterized in that a transfer chuck mounted on one end of a movable member may be positioned adjacent to a stack unit in which the paper sheets are stacked, and in that, after the number of the paper sheets is counted, the movable member is displaced for transporting the bundle of paper sheets towards the half-wrapping unit for half-wrapping as the bundle of paper sheets is gripped at one end by the transfer chuck.

BRIEF DESCRIPTION OF THE DRAWINGS

The objects and advantages of the present invention will become more apparent from reading the following detailed description in connection with the accompanying drawings, in which.

DESCRIPTION OF PREFERRED EMBODIMENTS

Figures 1, 2:
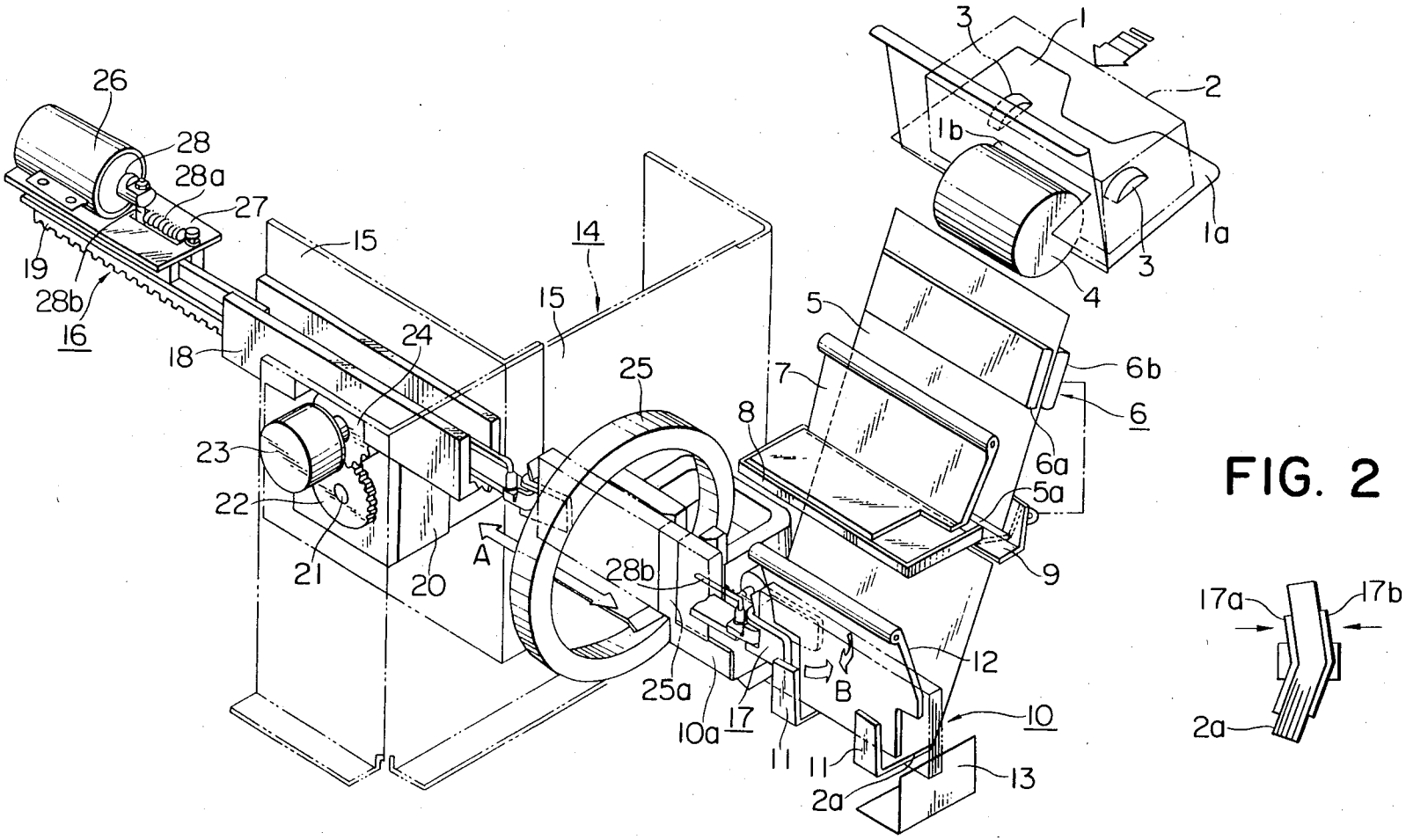
FIG. 1 is a schematic perspective view showing a counting and half-wrapping apparatus provided with a paper sheet grip and transport mechanism and adapted to be capable of discriminating the notes of different nominal values.
FIG. 2 is a schematic view showing a transfer chuck of the counting and half-wrapping apparatus of FIG. 1 in the chucking state.

A paper sheet gripping and transport apparatus according to the present invention is hereinafter described by referring to the accompanying drawings.

In the drawings, the numeral 1 designates an L-shaped stack plate on which is stacked a pile of a large number of banknotes 2. A pair of guide rolls 3 are projected partially through slits formed in a bottom portion 1*a* of the stack plate 1 to a level lying above the bottom plate 1*a*. A separating drum 4 is supported for rotation by an output shaft of a counting electric motor, not shown, and adapted for separately extracting these banknotes 2. The drum 4 is disposed partially within a recess 1*b* formed in the bottom portion 1*a*.

An inclined transport plate 5 providing a transfer passageway is provided below the stack plate 1. On the top of the transport plate 5, and adjacent to the stack plate 1, there is disposed a banknote sensing and discriminating unit 6 which is known per se and adapted for sensing the lengths of the long and short sides, pattern, magnetism or folded edges of the banknotes and discriminating the banknotes of different nominal values.

The sensing and discriminating unit 6 is comprised of electromagnetic means and has a signal generating section 6*a* and a signal receiving section 6*b* disposed in opposition to each other and on both sides of the transport plate 5. About centrally of the transport plate 5, there are provided an L-shaped note transfer security member 7 and a reject note stacker 8, said member 7 being carried for rotation by a main body of a half-wrapping device, not shown. On the side of the transport plate 5 opposite to the reject note stacker 8, a changeover shutter plate 9 is rotatably mounted on the main body of the half-wrapping device, not shown. The shutter plate 9 is connected to a driving unit, such as a solenoid, which is known per se and therefore not shown, and which is adapted for turning bidirectionally as shown by the solid and dotted lines in FIG. 1 for changing the transport direction of the banknotes. Thus the driving unit is controlled by output signals from the discriminating unit 6 in such a manner that, when the shutter plate 9 is turned to the dotted-line position and projected through an opening 5*a* in the shutter plate 5 towards the reject note stacker 8, the notes 2 are supplied to the stacker 8 and placed thereon, and that, when the shutter plate 9 is turned to the solid-line position, the notes 2 are transferred directly downward.

At the lower part of the transfer plate 5 and adjacent to the stacker 8, there is provided a stack unit 10 comprised of a stack plate 11 and a receiving plate 12. An L-shaped edge alignment plate 13 is provided adjacent to one of the sides of the stack plate 11 and the receiving plate 12. The receiving plate 12 is carried for rotation by the main body, not shown, of the half-wrapping device and turned clockwise in FIG. 1 as the notes are stacked on the stack plate 11.

A transfer chuck 17 attached to the foremost part of a slider 16 movable in the direction of the arrow mark A is operably mounted in alignment with the stack unit 10. The chuck 17 consists of a pair of chuck elements 17*a*, 17*b* (FIG. 2) that may be opened apart or closed by well-known means not shown, one element 17*a* of the chuck having a convex chuck surface and the other 17*b* having a concave chuck surface complementary to the mating chuck surface of the element 17*a*.

The slider 16 is movable on a slide guide with a longitudinal concave profile and has its lower surface formed as one with a tooth rack 19 meshing with a gear 24 of a braking unit 23, said gear meshing in turn with a pinion 22 of a rotary shaft 21 of a transport electric motor 20 which is mounted on a frame 15. The slider 16 may be reciprocated in the direction of the arrow mark A by the operation of the tooth rack 19.

A half-wrapper ring 25 of a known construction is mounted for encircling the foremost part of the movable member 16, and a stationary plate 27 having a gripping solenoid 26 is mounted to the rear of the movable member 16. An actuating rod 28 for solenoid 26 is connected to the transfer chuck 17 through a connecting rod 28*b*. The numeral 28*a* designates a return spring normally biasing the actuating rod 28 in a direction to open the transfer chuck 17.

The operation of the aforementioned counting and half-wrapping device provided with a paper sheet gripping and transfer mechanism and the function of discriminating between paper notes of different nominal values, is presently described.

A large number of banknotes 2 of different nominal values is stacked on the stack plate 1 and separately extracted in a known manner by the drum 4 which is driven in rotation by the counting electric motor, not shown. The notes 2 are then supplied to the discriminating unit 6 for discrimination of the nominal values and so forth of the notes 2.

In instances where a note 2 is found at the unit 6 to be folded at the corner or to be of other than the desired nominal value, the shutter plate 9 is turned to the doubledotted chain line position in such a manner that the note is supplied to and placed in the reject note stacker 8. On the other hand, in instances where a note is found to be of the desired nominal value, the shutter plate 9 is turned to the other or solid-line positon, in such a manner that the desired notes are caused to descend into a space between the opened chuck elements 17*a*, 17*b* and placed on the stack plate 11 of the stack unit 10.

When it is sensed by a counter, not shown, connected to the discriminating unit 6, that 100 (one hundred) notes of the desired nominal value, for example, have been deposited in the stack unit 10, the transport motor 20 is driven in reverse for slightly shifting the movable member 16 towards the stacker, so that the banknotes 2 are aligned edgewise by the alignment plate 13. When the grip solenoid 26 is energized in this state, the connecting rod 28*b* is moved along the slider 16 a distance necessary for chucking. The chuck elements 17*a*, 17*b* of the transfer chuck 17 are closed in the direction shown by the arrow mark B for chucking the one end or the half-wrapper side end of a bundle 2*a* of banknotes. At the same time that the bundle 2*a* is moved from the stack unit 10 towards the half-wrapping unit 14, the banknotes 2*a* of the next stack are introduced into the discriminating unit 6 for commencing the counting operation.

With the notes 2 thus chucked by the transfer chuck 17, the transport electric motor 20 is driven forward, in such a manner that the movable member 16 formed with the toothed rack 19 is displaced towards left in FIG. 1 along a straight path until the bundle 2*a* is pulled towards its leftward position as indicated by doubledotted chain line, that is, a position within the half-wrapper ring 25. During this time, the bundle 2*a* is kept in the chucked state. The slider 16 is then halted in a preset position by the operation of the braking unit 23, at the same time that a sealing tape 25*a* is applied in a known manner by the half-wrapper ring 25 on the periphery of the bundle 2*a* to complete the half-wrapping operation.

Figure 5:
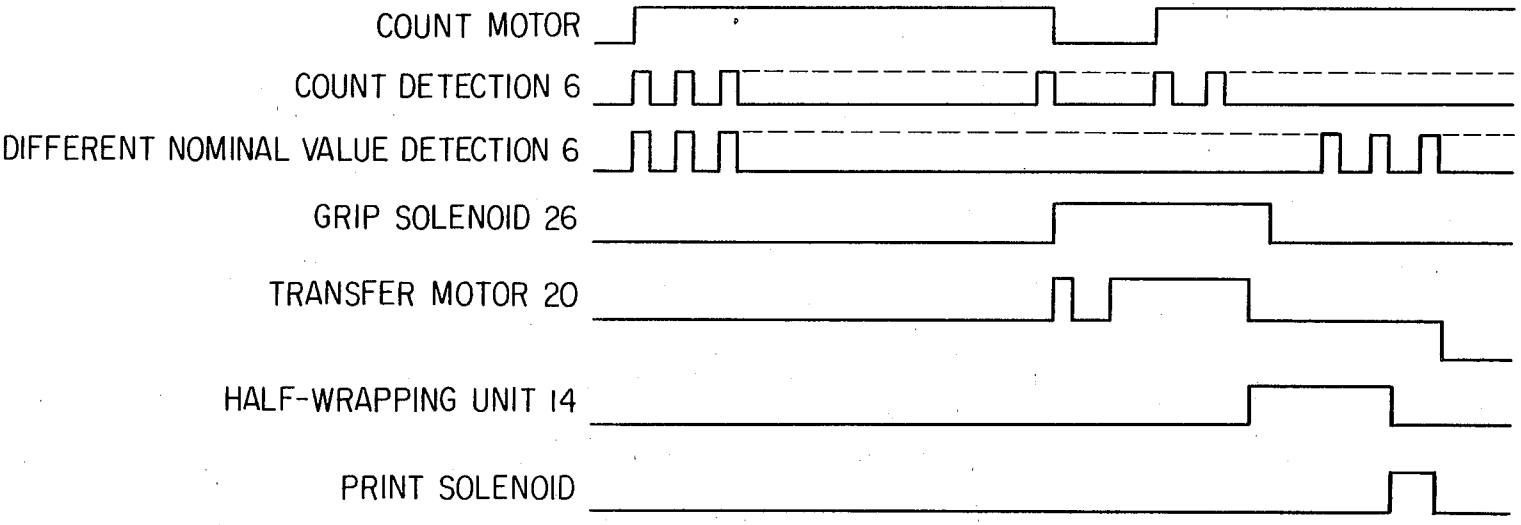
FIG. 5 is a timing diagram showing the operational timing for the sequence of operations carried out in the counting and half-wrapping device.

On completion of half-wrapping a printing solenoid, not shown, is energized for applying a stamp seal on the bundle 2*a*. The transport electric motor 20 is then actuated in reverse for shifting the bundle 2*a* out of the half-wrapping unit. Thus the bundle 2*a* is introduced into a bundle stacker, not shown, as it is guided by a supporting plate 10*a*. The transfer chuck is moved further and reaches a position to grip a new bundle of paper sheets, at which time the operation of the transfer electric motor ceases. FIG. 5 shows the operational timing of various operating parts in the course of the aforementioned sequence of operations.

Figure 3:
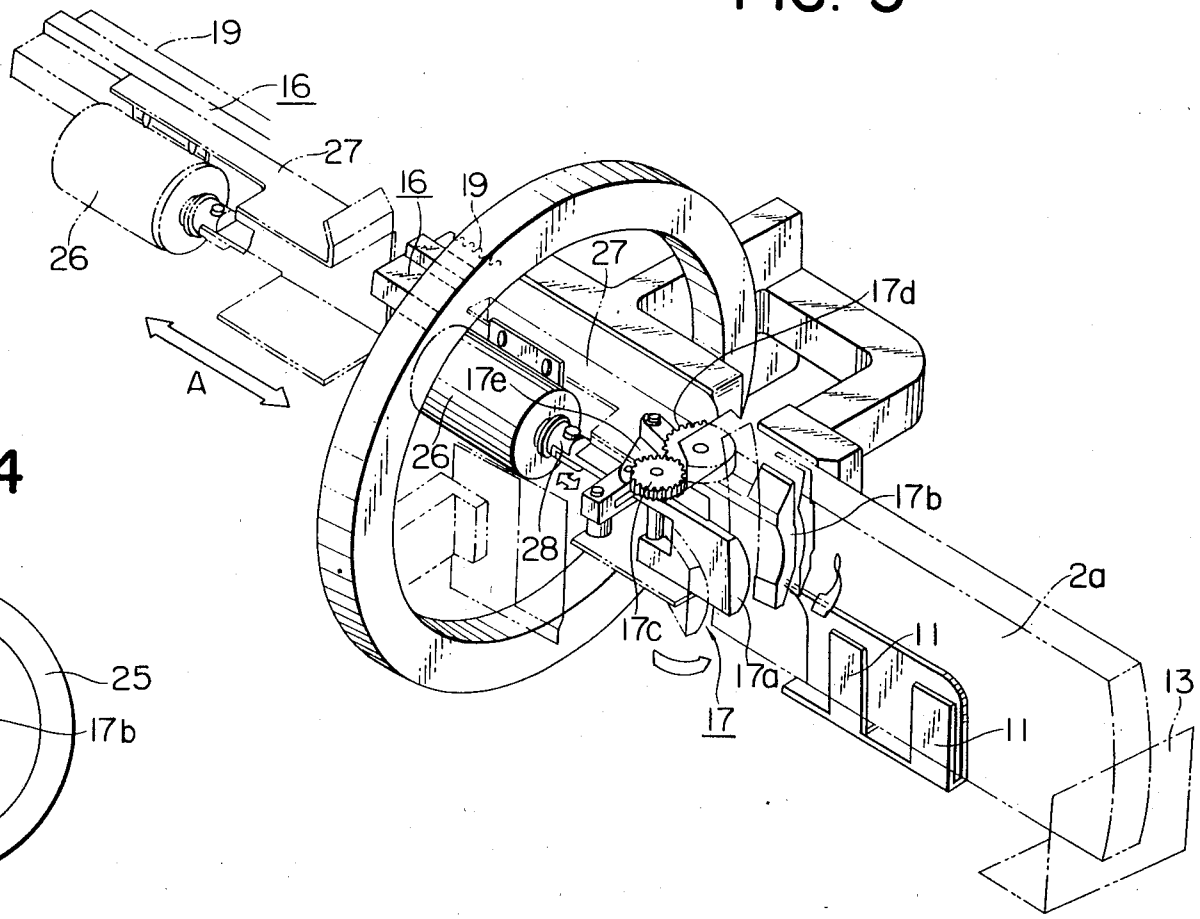
FIG. 3 is a schematic perspective view showing a modified embodiment of the grip and transfer apparatus in the counting and half-wrapping device shown in FIG. 1.

FIG. 3 shows a modified embodiment of the paper sheet gripping and transport apparatus of the present invention. In this modification, a tooth rack 19 is provided on the lateral side of the movable member 16, and the actuating rod 28 for the grip solenoid 26, which is mounted on a stationary plate 27 of the movable member 16, is coupled to an actuating lever 17*e* which, in turn, is associated with meshing gears 17*c*, 17*d* provided on chuck elements 17*a*, 17*b*.

The bundle 2*a* may be chucked in manner similar to the preceding embodiment by the operation of the solenoid 26. In FIG. 3, when the movable member 16 is at the solid-line position, the transfer chuck 17 is in the state of chucking or in the state ready to chuck the loose bundle at the stack unit 10. When the member 16 is in the double-chain-dotted line position, the chuck 17 is in the state of chucking the bundle 2*a* at the half-wrapping unit.

Figure 4:
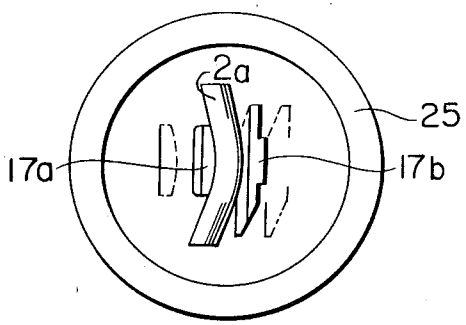
FIG. 4 is a schematic view showing the transfer chuck in the half-wrapping unit of FIG. 3 in the chucking state.

FIG. 4 shows the state in which the bundle 2*a* is chucked by the chuck elements 17*a*, 17*b* in FIG. 3, wherein it is shown that the bundle 2*a* is chucked securely in the bent state.

From the foregoing it is seen that the present invention provides a paper sheet gripping and transport apparatus according to which accidental deviation, loss or folding of the paper sheets during transport, or insufficient half-wrapping tightness due to transverse shifting of the paper sheets during transport towards the half-wrapper unit, may be eliminated for assuring a highly reliable band sealing. In addition, the time interval from the start of counting until the end of half-wrapping may be shortened because the counting for the next batch of paper sheets can be started as soon as a bundle of paper sheets clears the stack unit.

What is claimed is:

1. In a paper sheet counting and half-wrapping device of the type comprising a stack unit for receiving a plurality of paper sheets supplied thereto and stacking them as a bundle to be wrapped, said stack unit providing exposure of a free end of the bundle when stacked thereon, counting means for counting the number of said sheets in said bundle, and a half-wrapper unit including a half-wrapper ring mounted adjacent to said stack unit for receiving said bundle and wrapping the same when said bundle is transferred to within said ring from said stack unit, the improvement comprising a sheet bundle grip and transfer apparatus comprising a longitudinally movable member having an end carrying an openable and closable gripping chuck thereon, said movable member being mounted substantially on said half-wrapper unit for reciprocal movement through said half-wrapper ring between a first position wherein said chuck is on one side of said ring adjacent to said bundle free end for gripping the same and a second position wherein said chuck is on the opposite side of said ring whereby said bundle gripped by said chuck is within said half-wrapper ring to be wrapped therein, means normally retaining said chuck in its opened position when said movable member is in its said first position, means actuatable responsive to said counting means for closing said chuck on said bundle to grip the same in said first position of said movable member when a predetermined number of said sheets are within said bundle, and drive means actuatable responsive to said closing of said chuck for moving said movable member from its said first position to its second position.

2. The improvement according to claim 1, which further comprises an edge alignment plate adjacent to said stack unit for aligning said paper sheets within said bundle at the end thereof opposite to its said free end, said means actuatable responsive to said counting means further having means for moving said movable member from its said first position initially towards said alignment plate to align said sheets in said bundle before said closing of said chuck thereon.

3. The improvment according to claim 1, wherein said movable member comprises a linear toothed rack, and said drive means comprises a toothed pinion and a motor mounted substantially on said half-wrapper unit for rotating said pinion, said linear toothed rack engaging said toothed pinion.

4. The improvement according to claim 3, wherein said means for closing said chuck in said bundle comprises a solenoid mounted on said movable member and having an actuating rod, and means connecting said solenoid actuating rod to said chuck for opening and closing said chuck in response to actuation of said solenoid.

* * * * *